US006763786B2

(12) United States Patent
Vergara

(10) Patent No.: US 6,763,786 B2
(45) Date of Patent: Jul. 20, 2004

(54) EQUIPMENT FOR WATER HEATER

(75) Inventor: José M. Vergara, Laukiniz (ES)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/277,578

(22) Filed: Oct. 21, 2002

(65) Prior Publication Data

US 2004/0013989 A1 Jan. 22, 2004

(30) Foreign Application Priority Data

Oct. 24, 2001 (FI) ..... 20012054

(51) Int. Cl.[7] ..... F24H 1/40

(52) U.S. Cl. ..... 122/18.1; 122/18.2; 122/367.3; 126/101

(58) Field of Search ..... 122/13.01, 17.1, 122/17.2, 18.1, 18.2, 367.1, 367.3; 126/101; 165/152, 153

(56) References Cited

U.S. PATENT DOCUMENTS 4,434,845 A * 3/1984 Steeb ..... 165/153
4,645,000 A * 2/1987 Scarselletta ..... 165/152
4,674,566 A * 6/1987 Heine et al. ..... 165/134.1
4,756,475 A * 7/1988 Vergne ..... 237/56
5,476,375 A * 12/1995 Khinkis et al. ..... 431/7
5,505,257 A * 4/1996 Goetz, Jr. ..... 165/183
5,988,157 A * 11/1999 Brown et al. ..... 126/110 R

FOREIGN PATENT DOCUMENTS

DE 24 12 430 9/1975
EP 000337923 A2 * 10/1989
SU 2535708 * 2/1979

* cited by examiner

*Primary Examiner*—Jiping Lu
(74) *Attorney, Agent, or Firm*—Smith-Hill and Bedell

(57) ABSTRACT

The invention relates to an equipment to be used in a gas-fired water heater which equipment contains a combustion chamber (2) and a heat exchanger (1). Accordingly the combustion chamber (2) is made of a ceramic material and provided with slots (3) for crossing the heating elements (4) of the heat exchanger (1) through the opposite walls (5,6) of the combustion chamber (2).

5 Claims, 1 Drawing Sheet

EQUIPMENT FOR WATER HEATER

Figure 1:
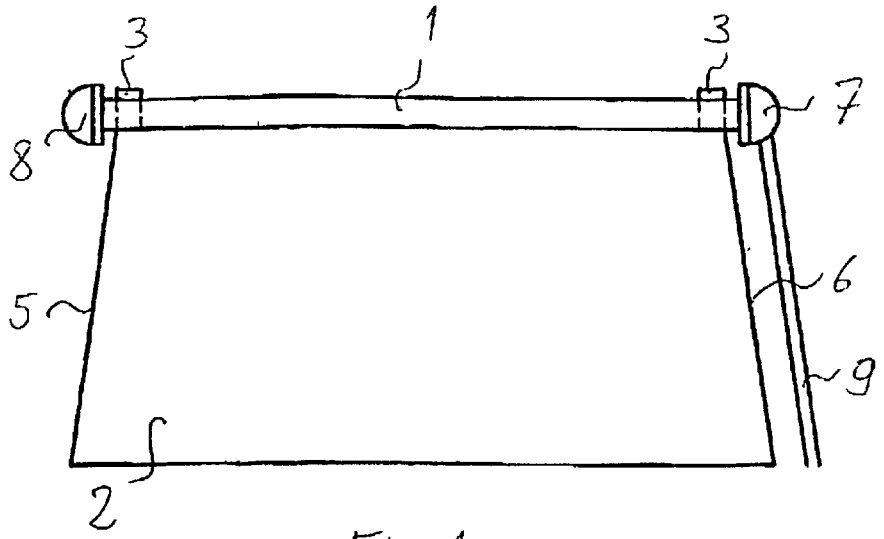

This invention relates to a gas-fired water heater which contains a combustion chamber and a heat exchanger which are made of different materials.

A gas-fired water heater is usually used to provide hot water to a household for daily sanitary needs. In order for the system to be practical, for instance to provide hot water to a person taking a shower, it is important that the gas-fired water heater be constructed to heat water as quickly as possible, when a person opens the hot water faucet, the heater starts to operate, causing the water flowing through the water heater to heat after which it flows to the faucet. In order to eliminate the risk of the water inside the pipes boiling, operation of the water heater is stopped just after the faucet is closed. In many cases the space for the gas-fired water heater is substantially small and, therefore, the gas-fired water heater has to be small enough to fit into the space reserved. Because the space reserved is small and usually the person living in the space, in an apartment for instance, that is provided with the gas-fired water heater can, during the operation of the gas-fired water heater, move very close to the gas-fired water heater, it is very important that the external surfaces of the gas-fired water heater remain at a temperature low enough to prevent burns.

The object of the present invention is to eliminate some drawbacks of the prior art and to achieve a new and more practical gas-fired water heater. The water heater comprises a combustion chamber and a heat exchanger. In an embodiment of the present invention the combustion chamber and the heat exchanger are fixed together and are made of dissimilar materials. Gas is burnt in the combustion chamber and the resultant hot gases are conducted towards heating tubes, or heating elements, of the heat exchanger which are located inside the combustion chamber. Water flows through the heating elements and absorbs heat from the hot gases.

The combustion chamber of a heater embodying the present invention is advantageously made of one piece of an insulating material. The insulating material is made of ceramics, which can be ceramic fiber, heat resistant mortar or the like. By using an insulating material the external surface of the combustion chamber is kept under a particular temperature range, which is essentially less than would be present if a non-insulating material was used. In order to make more effective the influence of the hot gases to the heating elements of the heat exchanger the shape of the combustion chamber is such that the cross-section of the combustion chamber will advantageously decrease towards the upper part of the combustion chamber and is advantageously rectangular. The combustion chamber has at least one pair of opposing walls.

In order to fix the heating elements of the heat exchanger to the combustion chamber in the preferred embodiment of the invention, the upper parts of the two opposing walls of the combustion chamber are provided with slots wherein the heating elements of the heat exchanger are installed. The slots in both walls are advantageously even in width. The slots in one wall are positioned so that the distance between two adjacent slots is essentially the same. The slots in the two walls are formed in pairs so that the heaving elements of the heat exchanger can be installed essentially transversely to the two other walls of the combustion chamber. The slots can be formed advantageously to the walls so that the two walls are provided with projections in the upper parts and the slots are positioned between these projections. The slots can be formed also to the walls so that the two walls are just provided with the slots. When using the projections for the slots the heating elements of the heat exchanger are installed above the level formed by the two other walls without the slots. When using the slots without any projections the heating elements of the heat exchanger are installed under the level formed by the two other walls without the slots.

The part of a heating element that is positioned between the walls of the combustion chamber, is under the influence of the hot combustion gases. The heating elements are advantageously provided with at least one fin on the external surface of each element. The fins are installed at least on the part of each element that is positioned between the walls of the combustion chamber. The fins are advantageously manufactured of a corrugated metal strip, which is soldered or brazed on the external surface of a heating element. Thus two adjacent heating elements have a common fin between them so that the corrugated strip is soldered or brazed alternately to both heating elements. The metallic material for the corrugated strip is advantageously copper or a copper alloy, aluminum or an aluminum alloy. The purpose of the projections is to exchange heat from the hot combustion gases to the metal of the heating element. The fins will also prevent the deformation of the heating elements in case of possible over-pressure as well as keep the desired distance between the heating elements.

The heating elements of the present invention are made of oval metal tubes, which have two substantially flat parallel sides and are installed in the slots of the combustion chamber advantageously so that the flat parts of the oval tubes are positioned essentially vertically. The oval tubes are arranged in the slots in one level or in multi level depending on the needs to heat water. The oval tubes are provided with fins on their flat surfaces, so that the fins have contact with two adjacent flat oval tubes.

Multiple heating elements are connected to one another via the collectors, which are installed outside the walls of the combustion chamber. The collectors can be made of many different materials; both metallic, such as copper, a copper alloy, aluminum, an aluminum alloy or steel, and non-metallic materials as polyamides or polybuthilen. The collectors will on one side form a continuous route for the water to be heated to flow through and on the other side at least one of the collectors is provided with at least one connecting element, which leads the water to be heated into the heat exchanger, and at least one of the collectors is provided with at least one connecting member, which leads the heated water away from the heat exchanger to be used in a desired manner.

When the gas-fired water heater is operating, gas to be burnt in the combustion chamber is led through a gas pipe into the combustion chamber and the hot exhaust gases from the combustion chamber flow towards the heating elements in the upper part of the combustion chamber. Inside the heating elements, the direction in which the water to be heated flows depends on the construction of the collectors.

Figure 2:
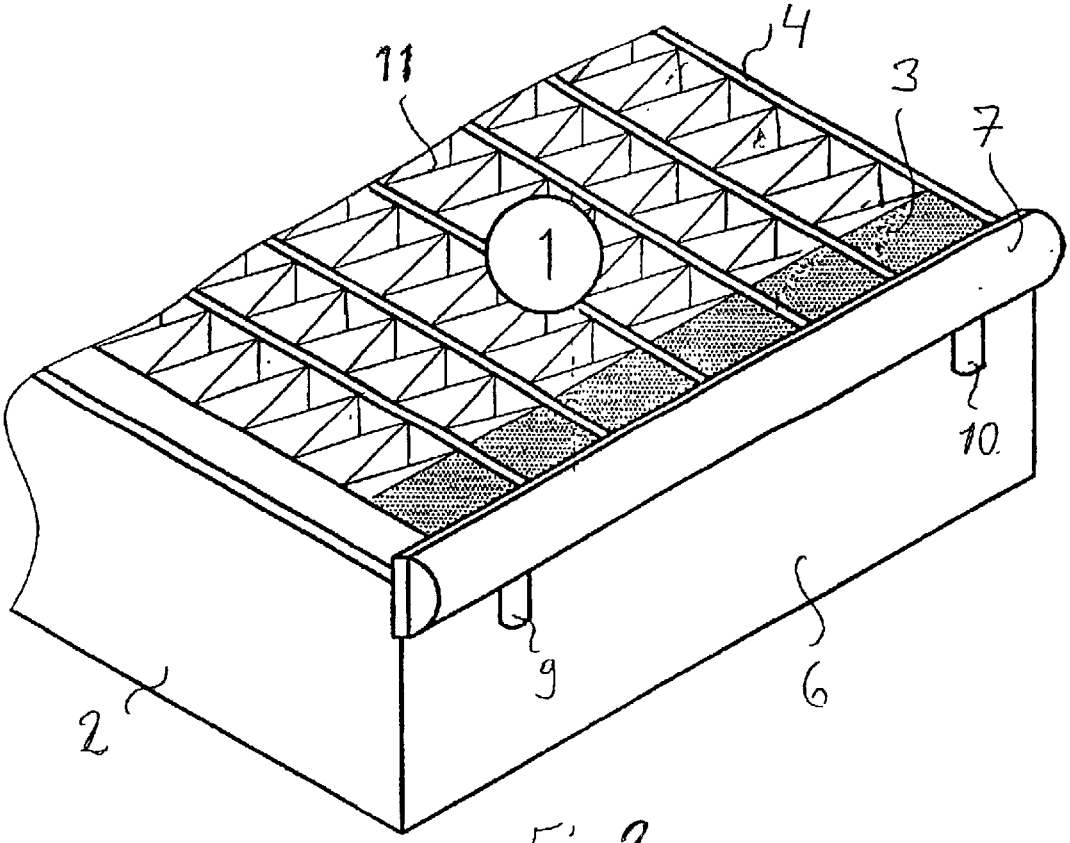

The invention is explained in more detail below, with reference to the appended drawings, where FIG. 1 shows a preferred embodiment of the invention, seen in a side-view illustration, and FIG. 2 shows a detail of the preferred embodiment of FIG. 1.

In accordance with FIG. 1 and FIG. 2 in the gas-fired water heater the heat exchanger 1 is fixed to the combustion chamber 2, which is made of heat resistant mortar, by slots 3 in the upper part of the combustion chamber 2. The oval tubes 4, which are made of copper, and operate as heating elements of the heat exchanger 1 cross the opposite walls 5 and 6 of the combustion chamber 2 by means of the slots 3 and are positioned so that the flat parts of the oval tubes 4 are substantially vertical. The oval tubes 4 are provided with corrugated copper fins 11 brazed on the flat parts of the oval tubes 4 and the fins 11 are sized so that one individual fin 11 will reach alternatively two adjacent oval tubes 4. The oval tubes 4 are connected by the collectors 7 and 8, which are installed outside walls 5 and 6 respectively of the combustion chamber 2. The collector 7 is provided with a connecting member 9 in order to lead water to be heated into the heat exchanger 1 and with a connecting member 10 in order to lead the heated water away from the heat exchanger 1.

What is claimed is:

1. A gas-fired water heater, said water heater comprising a combustion chamber, said combustion chamber being made of a thermally insulating material and comprising:

a first wall and a opposite second wall, said first and second walls each having an upper section, and a plurality of slot pairs, each said slot pair having a first slot formed in the upper section of the first wall and a second slot formed in the upper section of the second wall at a corresponding position to the first slot, and and a heat exchanger, said heat exchanger being at least partially made of a thermally conductive material and comprising:

first and second heating elements, each heating element having a first end mounted in the first slot of a slot pair and a second end mounted in the second slot of said slot pair, said heating elements being parallel to one another, and a corrugated metal strip having a first plurality of crests at one side of the strip and a second plurality of crests at an opposite side of the strip, the corrugated metal strip being attached at the first plurality of crests to the first heating element and being attached at the second plurality of crests to the second heating element.

2. A water heater according to claim 1, wherein the combustion chamber defines a passage for the flow of gas along a path, each slot has a longer dimension and a shorter dimension, the longer dimension being substantially aligned with said path, the heating elements are metallic tubes having a substantially oval cross-section, the oval cross-section having a longer dimension and a shorter dimension, the heating elements being positioned in the slots of the combustion chamber with the longer dimension of the oval cross-section substantially aligned with the longer dimension of the slot.

3. A water heater according to claim 2, wherein the heating elements have an exterior surface and the crests of the corrugated metal strip are soldered to said exterior surface of the first and second heating elements such that the crests are substantially aligned with the longer dimension of the heating element's oval cross-section.

4. A water heater according to claim 2, wherein the heating elements have an exterior surface and the crests of the corrugated metal strip are brazed to said exterior surface of the first and second heating elements such that the crests are substantially aligned with the longer dimension of the heating element's oval cross-section.

5. A water heater according to claim 1, further comprising a first collector mounted to the upper section of the first wall and connected to each of the heating elements at the first end thereof and a second collector mounted to the upper section of the second wall and connected to each of the hearing elements at the second end thereof.

* * * * *